US005351670A

United States Patent [19]

Buma et al.

[11] Patent Number: 5,351,670

[45] Date of Patent: Oct. 4, 1994

[54] IGNITION DISTRIBUTOR FOR AN INTERNAL COMBUSTION ENGINE

[75] Inventors: Kaneo Buma, Obu; Katsumaru Oda, Chiryu; Hideo Inaba, Kariya, all of Japan

[73] Assignee: Nippondenso Co., Ltd., Kariya, Japan

[21] Appl. No.: 976,940

[22] Filed: Nov. 18, 1992

[30] Foreign Application Priority Data

Nov. 21, 1991 [JP] Japan ..... 3-306235

[51] Int. Cl.[5] ..... F02P 1/00

[52] U.S. Cl. ..... 123/635; 123/146.5 A; 200/19 DC; 200/19 DR

[58] Field of Search ..... 123/146.5 A, 635; 200/19 DC, 19 DR

[56] References Cited

U.S. PATENT DOCUMENTS

| | | | |
|---|---|---|---|
| 3,941,107 | 3/1976 | Rockwell | 123/146.5 A |
| 4,077,378 | 3/1978 | Okumura | 200/19 DR |
| 4,129,107 | 12/1978 | Boyer | 123/146.5 A |
| 4,186,286 | 1/1980 | Kuo et al. | 123/146.5 A |
| 4,562,317 | 12/1985 | Gerber et al. | 200/19 DR |
| 4,719,883 | 1/1988 | Yokoyama et al. | 123/146.5 A |
| 4,979,486 | 12/1990 | Shimada et al. | 123/635 |
| 5,028,868 | 7/1991 | Murata et al. | 123/146.5 A |
| 5,094,219 | 3/1992 | Koshida et al. | 123/146.5 A |

FOREIGN PATENT DOCUMENTS

| | | |
|---|---|---|
| 63-75356 | 4/1988 | Japan . |
| 3160154 | 7/1991 | Japan . |

*Primary Examiner*—E. Rollins Cross
*Assistant Examiner*—Weilun Lo
*Attorney, Agent, or Firm*—Cushman, Darby & Cushman

[57] ABSTRACT

An ignition distributor has a hollow housing. A distributor cap having a caved portion that extends in the housing is mounted on one end of the housing. The other end of the housing supports a rotation shaft. An ignition coil is disposed in the caved portion of the distributor cap. A rotor electrode of a distributor section is connected to the shaft, and rotates around the caved portion of the distributor cap. Side electrodes are arranged to face the rotor electrode with its rotation. Thus, the space surrounding the ignition coil is fully utilized to arrange the distributor section. This results in a compact ignition distributor.

16 Claims, 5 Drawing Sheets

IGNITION DISTRIBUTOR FOR AN INTERNAL COMBUSTION ENGINE

BACKGROUND OF THE INVENTION

The present invention relates to an ignition distributor for an internal combustion engine in which an ignition coil is mounted in a distributor cap in one united body.

An ignition distributor for an internal combustion engine which has an ignition coil mounted thereon in one united body has been proposed in, for example, Japanese Patent Unexamined Publication No. 63-75356. In the ignition distributor described in the publication, an ignition coil is placed on the upper part of a distributor cap and projecting above the distributor.

In the ignition distributor described in the above publication, since the ignition coil is mounted on the distributor cap, an extra storage space is necessary for the ignition coil separately from a space for a distributor section. Furthermore, the additional space protrudes above the distributor, and it is difficult to further reduce the whole distributor in size, which includes the distributor section and the ignition coil.

SUMMARY OF THE INVENTION

The present invention has an object of providing an ignition distributor for an internal combustion engine that includes an ignition coil in one united body and that is more compact as compared with the conventional art.

Another object of the invention is to provide an ignition distributor for an internal combustion engine in which a distributor section and an ignition coil are arranged in a space saving manner and other parts can also be incorporated.

To achieve the above objects, the invention is intended to arrange an ignition coil on the inside of an ignition distributor and provide a distributor section around the ignition coil.

According to the invention, an ignition distributor has a hollow housing which rotatably supports at one end thereof a drive shaft, and a distributor cap is installed at the opposite end of the housing. The distributor cap has a portion which is caved toward the drive shaft. The ignition coil is incorporated in the caved portion. A space continuous in the circumferential direction is formed around the caved portion of the distributor cap. A rotor electrode is arranged in the continuous space and fixed to the drive shaft via a holding member to rotate within the continuous space when driven by the shaft. Side electrodes are projecting into the continuous space to face the rotating rotor electrode and constitute, in cooperation with the rotor electrode, a distributor section.

With the above construction, a receiving portion for the ignition coil projects from the distributor cap toward the tip of the drive shaft. Utilizing the continuous space around the outer circumference of the ignition coil receiving portion, the distributor section can be installed.

If the housing and the holding member for the rotor electrode are shaped like a cylinder and a bowl respectively, an additional space can be created between the housing and the holding member. The additional space can be utilized fully for arranging a rotation angle sensor or the like.

BRIEF DESCRIPTION OF THE DRAWINGS

The above and other object-, features and advantages will become clear from the detailed description which will be made later with reference to the accompanying drawings wherein.

DETAILED DESCRIPTION OF PREFERRED EMBODIMENT

Figure 1:
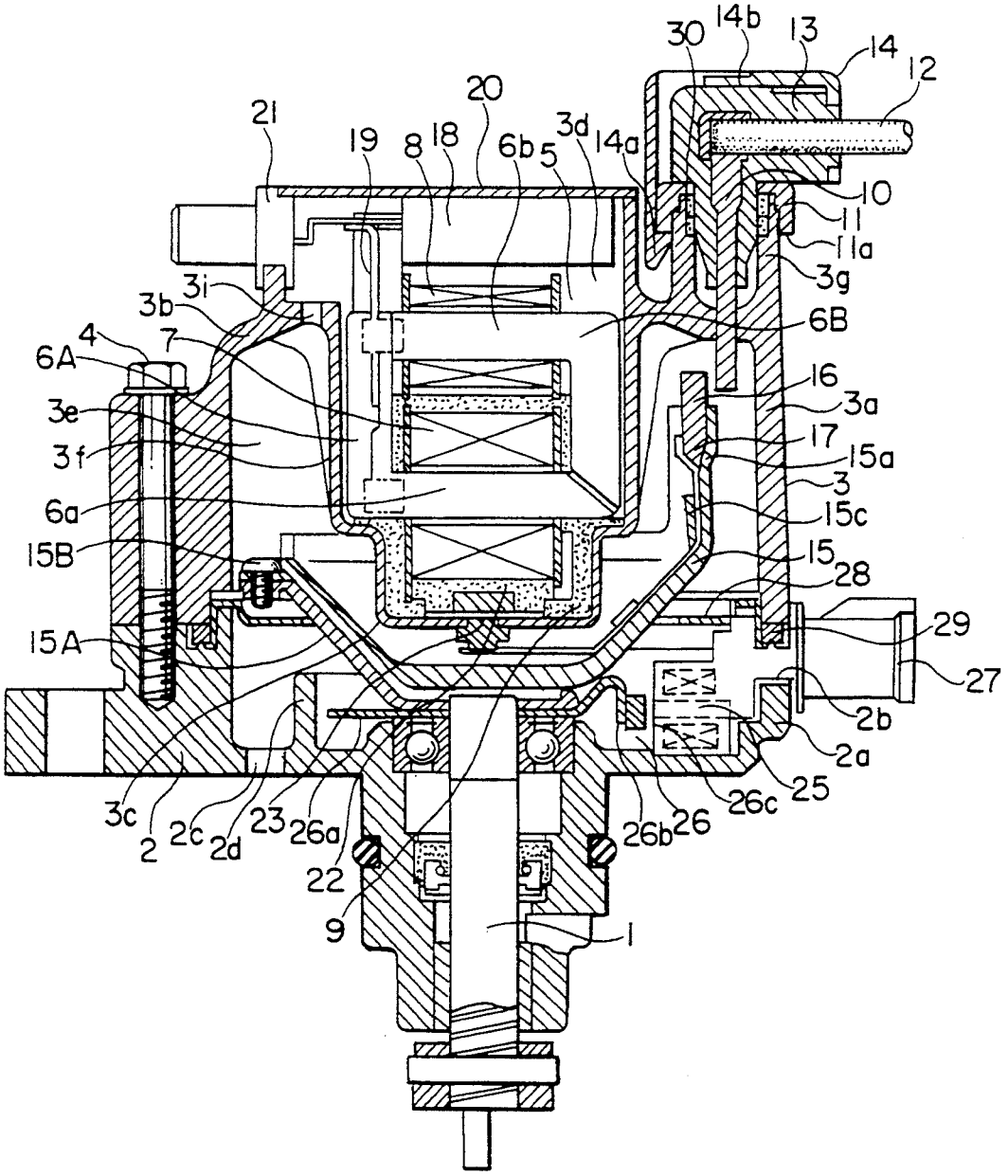
FIG. 1 is a longitudinal section view of an ignition distributor for an internal combustion engine according to an embodiment of the invention.
Figure 2:
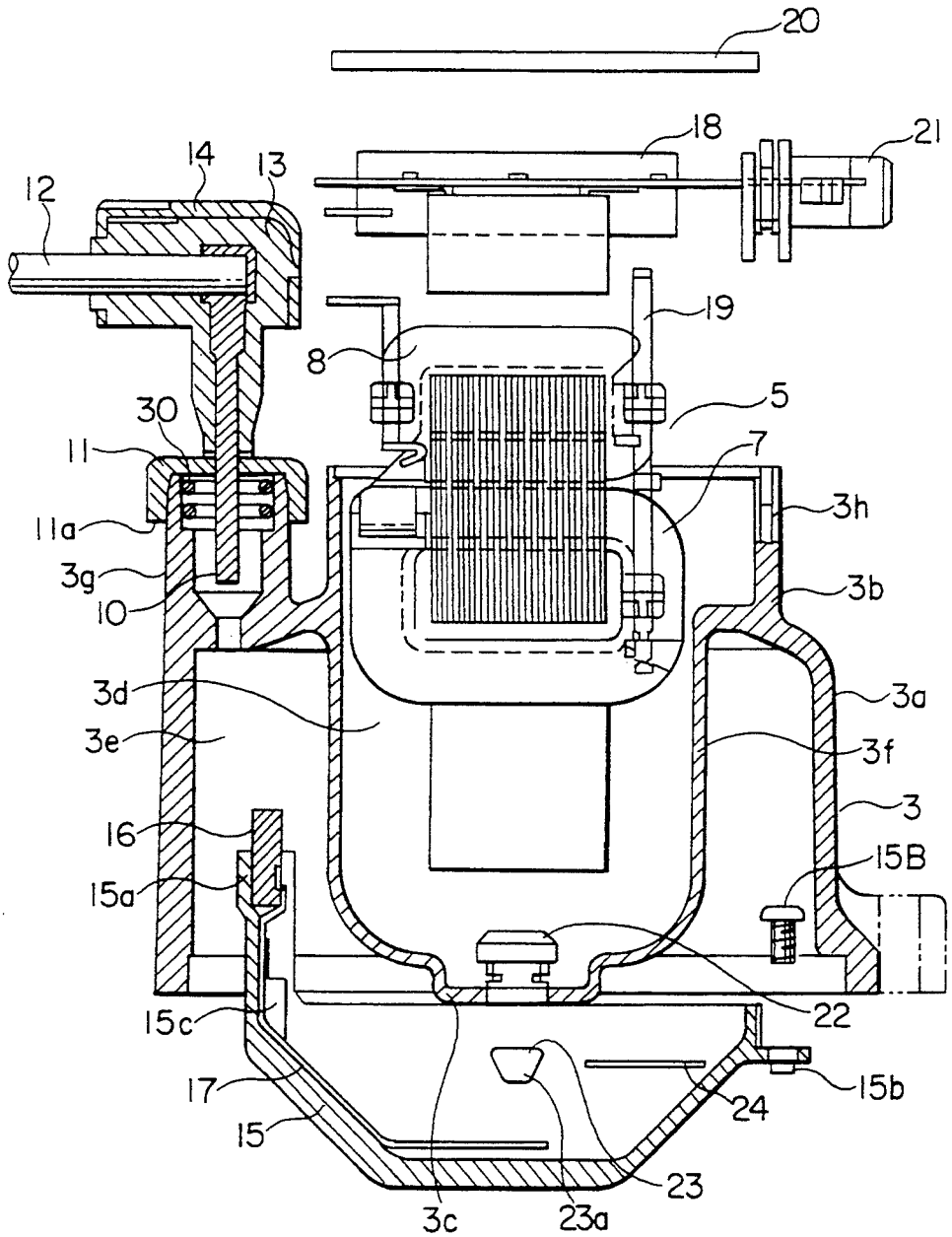
FIG. 2 is a longitudinal section view of the upper half of the ignition distributor shown in FIG. 1.
Figure 3:
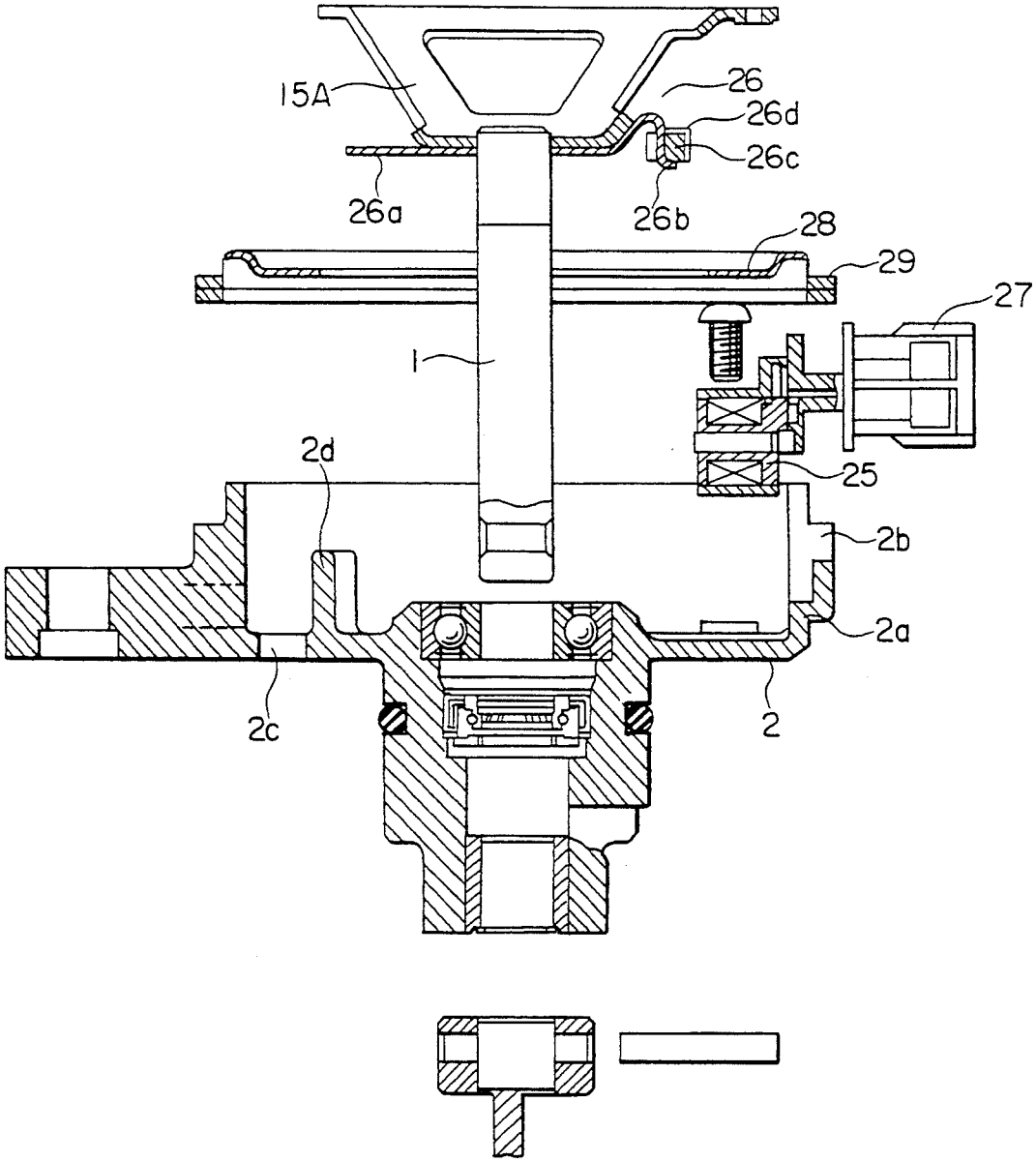
FIG. 3 is a longitudinal section view of the lower half of the ignition distributor shown in FIG. 1.

The invention will be now described in conjunction with an embodiment shown in the accompanying drawings. In FIGS. 1 to 3, a reference numeral denotes a shaft of an ignition distributor. The shaft is adapted to be connected to a cam shaft (not shown) of an internal combustion engine, and driven to rotate. The shaft 1 is held in a housing 2 in a rotatable manner. The housing 2 has a cylindrical side wall 2*a* that is relatively low. A reference numeral 3 denotes a distributor cap made of a synthetic resin that is an electrical insulating material. The distributor cap 3 has a cylindrical outer-circumference wall 3*a* that is attached to the side wall 2*a* of the housing 2 with bolts 4, a radial wall 3*b* extending in the inner-diameter direction from an end of the outer-circumferential wall 3*a* on the opposite side of the housing 2, and a bottom wall 3*c* extending from the radial inside of the radial wall 3*b* toward the tip of the shaft 1. The distributor cap 3 further includes a coil receiving portion 3*f* that defines a coil receiving space 3*d* on the opposite side of the shaft 1 and forms a ring space 3*e* along the outer wall 3*a*.

A reference numeral 5 denotes an ignition coil stored in the coil receiving space 3*d*. The ignition coil has parallel magnetic path portions 6*a* and 6*b* that extend in parallel with the bottom wall 3*c* of the coil receiving portion 3*f*. The ignition coil 5 includes two L-shaped cores 6A and 6B that constitute a closed magnetic path when combined in a rectangular form, a secondary coil 7 wound around the magnetic path portion 6*a* that lies near the bottom wall 3*c*, and a primary coil 8 wound around the magnetic path portion 6*b* that lies apart from the bottom wall 3*c*. An insulating resin member 9 is filled partly to the circumference of the secondary coil 7 in the coil receiving space 3*d*. Thus, the primary coil 8 and secondary coil 7 are separated from each other. The secondary coil 7 is placed below the primary coil 8, and the insulating resin member 9 is filled partly to the circumference of the secondary coil 7. This arrangement realizes a structure that, while ensuring dielectric withstanding voltage for the secondary coil 7, materializes a lightweight ignition coil 5 because of the reduced filling of the insulating resin member 9 to the ignition coil 5. Furthermore, the center of gravity of the ignition coil 5 can be lowered. Thus, the above structure is suited for the distributor cap 3 with an ignition coil united therein.

Then, side electrodes 10 corresponding to the number of cylinders of the internal combustion engine are arranged at given intervals in the vicinity of the radial wall 3*b* of the distributor cap, which are projecting into the ring shaped space 3*e*. Describing the structure for the side electrodes in detail, towers 3*g* are formed at given intervals on the radial wall 3*b* of the distributor cap 3 to protrude in the axial direction, which number the same as the cylinders. A ring like stopper member 11 is immobilized along the outer periphery of the tip of each tower 3*g*. The lower end of each of the stopper members 11 forms a ring shaped step 11*a* on the outer periphery of each tower 3*g*. High-tension cords 12 are connected with the respective upper ends of the side electrodes 10 to extend horizontally. Joints between the side electrodes 10 and the high-tension cords 12 are molded with a resin to form molded portions 13 except for the distal portions of the respective side electrodes 10. A reference numeral 14 denotes holding members of a synthetic resin for joining and holding the molded portions 13 with the associated towers 3*g*. In each of the holding member 14, a pair of claws 14*a* that hook at the ring shaped step 11*a* of each tower 3*g* and a resin spring 14*b* for pressing each molded portion 13 onto the tower 3*g* with an elastic force are formed integrally with the holding member.

A reference numeral 15 denotes a distribution rotor made of an insulating material (synthetic resin). The distribution rotor 15 is attached to the tip of the shaft 1, and extends from the shaft tip around the coil receiving portion 3*f* toward the ring like space 3*e*. The distribution rotor 15 is shaped like a bowl. A reference number 15A denotes a rotor holding plate of a metal for joining the rotor 15 with the shaft 1. The holding plate 15A has a curved shape like part of a bowl, which extends from the tip of the shaft 1 along the outer side surface of the bowl-like rotor 15. The holding plate 15A is fixed to the tip of the shaft 1 by welding, and holds firmly the bowl shaped rotor 15 at its outer-diameter side by means of a screw 15B. The rotor 15 and the rotor holding plate 15A are positioned with respect to each other by a projection 15*b* and a hole (not shown) into which the projection 15*b* is fitted.

A reference numeral 16 denotes a rotor electrode made of a ceramic resistor, which is adapted to be supplied with a high voltage from the ignition coil 5. The rotor electrode 16 is mounted on the distribution rotor 15 so as to face the side electrodes 10 one by one with the rotation of the shaft 1. The rotor electrode 16 is adhered fixedly to the inner-circumferential surface of a tongue 15a that extends from a part of the outer-diameter end of the distribution rotor 15 in the axial direction, so that the length of the rotor electrode will come in the axial direction of the distributor. Furthermore, the rotor electrode is pressed on the tongue 15*a* by one end of a metal plate spring 17. The rotor electrode 16 has a radial outside surface that faces the side electrodes 10 and is formed in an arc shape. The upper end of the radial outside surface is projecting above the tongue 15*a*.

A reference numeral 18 denotes an igniter that is located on the opening side of the coil receiving space and used to disconnect a primary current generated by the ignition coil 5. A reference numeral 19 denotes a metal plate terminal for electrically coupling the igniter 18 with the ignition coil 5 in the coil receiving space 3*d*. A reference numeral 20 denotes a heat radiation shield that is located at the opening end of the coil receiving portion 3*f* to cover the coil receiving space 3*d* and that is in close contact with the side of the igniter 18. A reference numeral 21 denotes a connector for supplying signals and power to the igniter 18 from external units. The connector 21 is adhered fixedly to a notch 3*h* that is formed in the opening end of the coil receiving portion 3*f*.

Figure 5A:
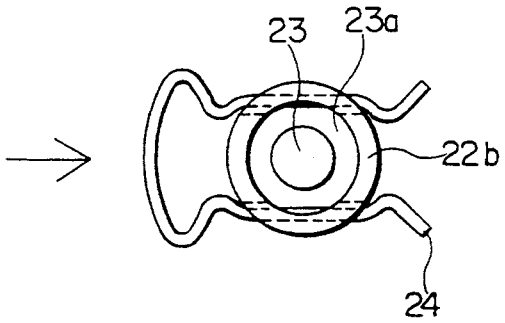
FIGS. 5A and 5B are a plan view showing an example of a construction for fixing a brush to a center electrode in the ignition distributor shown in FIG. 1 and a longitudinal section view of the construction, respectively.
Figure 5B:
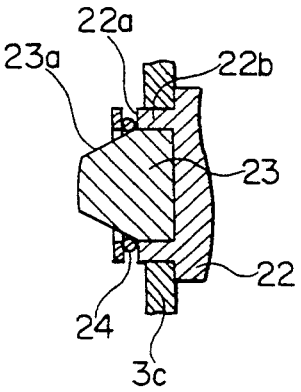

In the radial wall 3*b* of the distributor cap 3, a hole 3*i* is formed to allow the coil receiving space 3*d* to communicate with the ring space 3*e*. A reference numeral 22 denotes a center electrode to which the high voltage of the ignition coil 5 is supplied. The center electrode 22 is fixed to the bottom wall 3*c* of the coil receiving portion 3*f*, and has a cylindrical brush receiving portion 22*b* (see FIGS. 5A and 5B) at its distal end. In the opening end of the brush receiving portion, a pair of spring insertion grooves 22*a* are formed on the opposite sides of the receiving portion to extend in parallel with each other in the tangential directions while each partially penetrating the wall of the brush receiving portion. A reference numeral 23 denotes a carbon brush that is received in the brush receiving portion 22*b* and has a distal end which is shaped like a truncated cone to form a tapered portion 23*a* (see FIG. 5B). A reference numeral 24 denotes a clip like spring that is inserted into the spring insertion grooves 22*a* to clamp the tapered portion 23*a* of the brush 23. The other end of the plate spring 17 is elastically in contact with the tip of the brush 23. The plate spring 17 is fixed to the distribution rotor 15 by thermally caulking a projection 15*c* which is formed on the distribution rotor 15. Thereby, the high voltage from the center electrode 22 is supplied to the rotor electrode 16 through the plate spring 17.

A reference numeral 25 denotes a rotation angle sensor. The rotation angle sensor 25 is separated from the ignition coil 5 by the bowl-like distribution rotor 15 and is arranged in the housing 2 at a position which is almost parallel with the distal end of the shaft 1 as viewed in the axial direction. A reference numeral 26 denotes a signal rotor that is opposed to the rotation angle sensor 25 and fixed to the distal end of the shaft 1. The signal rotor 26 consists of a magnet holding plate 26*a* made of a metal, a permanent magnet 26*c*, and a non-magnetic metal plate 26*d*. The holding plate 26*a* is welded to the back of the rotor holding plate 15A and thus fixed to the distal end of the shaft 1 via the rotor holding plate 15A. The permanent magnet 26*c* is held on the outer periphery of a curved portion 26*b* that is formed on a part of the magnet holding plate 26*a*. The metal plate 26*d* covers the outer periphery of the magnet. 26*c* and is fixed to the curved portion 26*b* (see FIG. 3). The rotation angle sensor 25 consists of an electro-magnetic pickup for generating an output voltage according to a variation in interlinkage flux retained in the permanent magnet 26*c*, or a hole sensor. A connector 27 for transmitting an output of the sensor into an external unit is formed in one united body with the rotation angle sensor 25 by means of a resin. Then, the connector 27 is fitted into the notch 2*b* that is formed in the opening end of the side wall 2*a* of the housing 2.

An air vent hole 2*c* is formed on the outer peripheral side of the bottom wall of the housing 2. A screen 2*d* is formed on the bottom wall of the housing 2 inside of the air hole 2*c* to project in the axial direction inward of the housing 2. A reference numeral 28 denotes a ring like pressure-proof cover which is made of a synthetic resin. The pressure-proof cover 28 is disposed between the distribution rotor 15 and the rotation angle sensor 25. A ring like rubber seal member 29 is attached all over the outer peripheral edge of the pressure-proof cover 28. The outer peripheral edge of the pressure-proof cover 28 is clamped via the seal member 29 between the side wall 2*a* of the housing 2 and the outer-circumferential wall 3*a* of the distributor cap 3.

The coil receiving portion 3*f* is protruding into the distributor cap 3. The bowl-like distribution rotor 15 is extending from the tip of the shaft 1 around the coil receiving portion into the ring like space 3*e* on the outer peripheral side of the coil receiving portion 3*f*. Thus, the distributor section is constructed by utilizing the ring like space on the outer peripheral side of the coil receiving portion 3*f*. Moreover, when the space on the outer peripheral side of the distal end of the shaft 1 is utilized fully as a space for arranging the rotation angle sensor 25 and the pressure-proof cover 28, an efficient structure in which parts occupy most of the space can be realized. Consequently, the size of an entire ignition distributor can be more compact.

As described above, the ignition distributor of this embodiment has a structure in which the ignition coil 5 and the igniter 18 are mounted on the distributor cap 3 from above or the outside. Therefore, the primary coil 8 of the ignition coil 5 and the igniter 18 have to be prevented from being exposed to outside air and subjected adverse effects due to water and dust (for example, deterioration in electrical insulation performance, corrosion, etc.). For this purpose, the plate 20 is placed to cover the ignition coil receiving space 3*d*. The plate 20 is brought into close contact with the igniter 18 when mounted, and serves also as a heat radiation plate.

However, when the ignition coil receiving space 3 is sealed completely, condensation occurs due to a difference in temperature between the inside and outside airs. The above-described adverse effects to the internal parts are also concerned about. This arises a necessity of an air release hole that allows the ignition coil receiving space 3*d* of the distributor cap 3 to communicate with outside air. However, if an attempt is made to provide an air communication hole on the heat radiation plate 20, a measure to prevent water from entering (for example, a rubber cap having a labyrinth) must be taken in any shape. This in turn leads to an increase in an overall length of the assembly or in the number of parts.

In the ignition distributor of this embodiment, a hole 3*i* is formed in the dead space on the back of the cap 3 during molding of the cap 3, thus avoiding the above described adverse effects. This structure enables reduction in the overall length and decrease in the number of parts.

Figure 4:
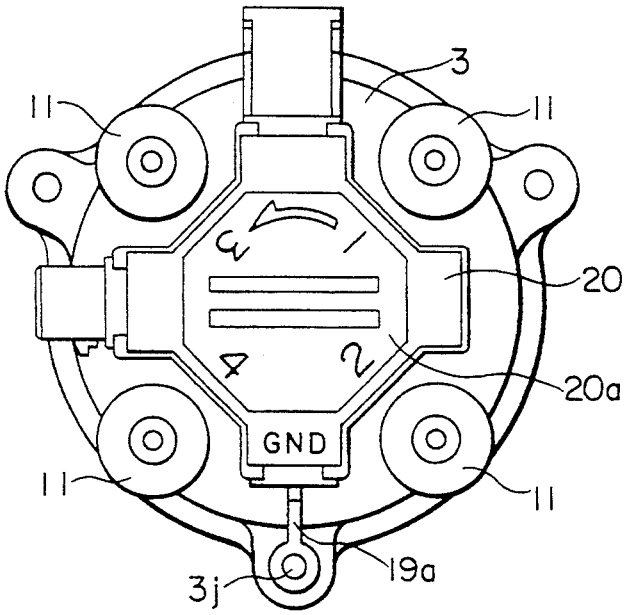
FIG. 4 is a plan view showing a distributor cap for the ignition distributor shown in FIG. 1.

Normally, cylinder numbers and a rotating direction have to be indicated clearly on the cap 3. The cylinder numbers and rotating direction usually differ with an internal combustion engine. Therefore, when an attempt is made to indicate cylinder numbers by means of a mold for the cap 3, a different mold must be prepared for every internal combustion engine. In the ignition distributor of this embodiment, however, a name plate 20*a* indicating a product number, cylinder numbers, and a rotating direction as shown in FIG. 4 (the product number differs with an internal combustion engine) is adhered to the top of the heat radiation plate 20. Accordingly, a meritorious result that a single mold for the cap 3 is used commonly can be achieved.

A ground terminal connected with the igniter 18 is extending, as shown in FIG. 4, through a plate terminal 19*a* to one of bolt insertion holes 3*j* which are formed on the outside of the distributor cap 3. When the plate terminal 19*a* is fixed to the housing 2 together with the cap 3 by means of the bolt 4, the terminal 19*a* is earthed to the main body of the internal combustion engine via the bolt 4 and the housing 2 (both made of an electric conductive metal material).

Subsequently described is a section for transmitting the high voltage generated by the ignition coil 5 to the distribution rotor 15. A carbon brush has usually been employed for the section. As a method for realizing a structure that enables a reduced overall length of an ignition distributor, there is a method of caulking and fixing the carbon brush to the electrode 22. In this case, however, the carbon brush becomes undetachable and, thus, this method has a drawback that market serviceability of the ignition distributor is not good.

In the distributor of this embodiment, as shown in FIG. 5, the clip like spring 24 is inserted from the indicated by an arrow (a direction perpendicular to the shaft 1). Thereby, the truncated conical carbon brush 23 is fixed to the aluminum center electrode 22 in a detachable manner.

At this time, if the structure is such that the tapered portion 23*a* of the carbon brush 23 is clamped with the spring 24, a force for pressing the carbon brush 23 onto the center electrode 22 (a force in the axial direction of the shaft 1) is produced to prevent backlash of the carbon brush 23.

Figure 6A:
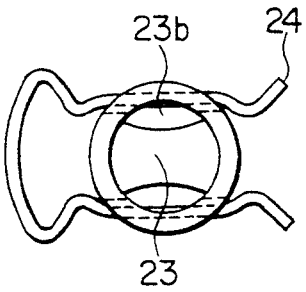
FIGS. 6A and 6B are a plan view showing a modification of the construction for fixing the brush to the center electrode in the ignition distributor shown in FIG. 1 and a longitudinal section view of the modification, respectively.
Figure 6B:
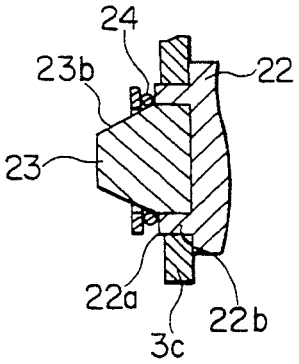

Alternatively, instead of the truncated conical tapered portion 23*a*, as shown in FIG. 6, taperingly-notched portions 23*b* may be formed on both sides of the distal end of the carbon brush 23. This modification can prevent the carbon brush 23 from rotating. Furthermore, since the spring 24 clamps the brush 23 in a linear-contact state, a stress exerted on the carbon brush 23 can be minimized.

Next, how to minimize ignition noises in the ignition distributor of this embodiment will be described.

Figure 7:
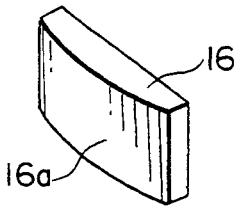
FIG. 7 is a perspective view of a rotor electrode used for the ignition distributor shown in FIG. 1.

As a conventional means for minimizing an ignition noise, a rotor electrode made of a thin ceramic resistor has been used at the discharging end of a distribution rotor. However, in a product having a structure described herein, when a rotor electrode made of a thin ceramic resistor is arranged vertically on a shaft, a problem arises in that the size of the product becomes large. Then, in the ignition distributor of this embodiment, the rotor electrode 16 is positioned upright along the axis of the shaft 1. A radial outside surface 16*a* of the rotor electrode 16 facing side electrodes 10 is shaped like an arc as shown in FIG. 7, so that the distance between the rotor electrode 16 and each of the side electrodes 10 facing the rotor electrode will not vary with a difference in ignition time.

When this kind of rotor electrode 16 is employed, if the metal plate spring 17 for providing electrical connection and preventing the rotor electrode 16 from coming off from the distribution rotor 15 is distanced too short from each of the side electrodes 10, since the rotor electrode 16 has a low impedance, there is a possibility that discharge will be induced directly from the metal plate spring 17 to any of the side electrodes 10. Consequently, ignition noises are not reduced. In the ignition distributor of this embodiment, however, the upper part of the radial outside surface 16*a* of the rotor electrode 16 faces the side electrodes 10, and the lower part of the inner peripheral side thereof is clamped by the plate spring 17. Therefore, a sufficient distance can be retained between the plate spring 17 and the side electrode 10.

Next, regarding the joints between the ignition distributor and the high-tension cords 12, the embodiment employs the following structure which satisfies all the requirements for compactness, easy detachment, freedom in determining directions of pulling out the high-tension cords 12, sealing efficiency, and cost-effectiveness.

Each side electrode 10 is attached vertically to the end of each of the high-tension cords 12. Then, the side electrode and the high-tension cord 12 are molded with a resin except the distal portion of the side electrode 10. The molded portion 13 is mounted on each of the towers 3*g* of the distributor cap 3 by means of the separate resin holding member 14 which is provided with the claws 4*a*. The ring like stopper 11 is immobilized at the tip of each tower 3*g* of the distributor cap 3. When the pair of claws 14*a* of the holding member 14 hook at the ring like step 11*a* formed by the lower end of the stopper 11, the high-tension cord 12 is coupled to the distributor cap 3 perfectly.

With the foregoing structure, as compared with a structure wherein fittings of high-tension cords and side electrodes on a distributor cap are directly connected in series, respectively, the distributor can be made more compact.

Furthermore, each of the high-tension cords 12 can be detached easily from the distributor cap 3 by removing the pair of claws 14*a* from the stopper 11.

Moreover, since the stoppers 11 are of a ring shape, the holding members 14 need not be manufactured differently according to the directions of pulling out the high-tension cords 12. Using holding members 14 of the same type, the high-tension cords 12 can be pulled out in any directions.

In each of the holding members 14, the resin spring 14*b* is formed in one united body on the ceiling. Each high-tension cord 12 is held by the spring force the spring 14*b*. This holding method is more cost-effective than a conventional method of using a reaction force of a grommet made of an expensive silicon rubber.

Furthermore, two or more O rings 30 are used between the inner peripheral surface of each tower 3*g* and the outer periphery of the associated side electrode 10. This contributes to improvement of reliability.

The above described ring like stoppers 11 have also a function of preventing the O ring 30 from falling away.

In the above described embodiment, the distribution rotor 15 is shaped like a bowl. The distribution rotor 15, however, may have any shape as far as it includes the tongue 15*a*, a holding portion for the plate spring 17 and a portion for being locked on the holding plate 15A, and is curved to extend from the tip of the shaft 1 around the coil receiving portion 3*f* toward the ring like space 3*e*.

According to the invention, as described so far, the ring like space on the outer peripheral side of the coil receiving portion, that protrudes from the distributor cap toward the tip of the shaft can be utilized to constitute the distributor section. Furthermore, the distributor section and the ignition coil can be arranged compactly. This efficiently-arranged construction achieves a meritorious result that an ignition distributor can be compact.

Furthermore, a space on the outer peripheral side of the distal portion of the shaft can be utilized as a space for arranging the rotation angle sensor This will further improve a space factor of parts.

What is claimed is:

1. An ignition distributor for an internal combustion comprising:

a hollow housing;

a distributor cap mounted on one end of said housing and having a caved portion, said caved portion extending toward said housing and defining a space continuous in a circumferential direction around said caved portion;

an ignition coil mounted in said caved portion of said distributor cap; and a distribution section including a shaft rotatably supported at an opposite end of said housing and adapted to be driven by the internal combustion engine, a rotor electrode arranged in said continuous space, holding means for holding said rotor electrode, joining said rotor electrode with said shaft in a rotatable manner, and electrically connecting said ignition coil to said rotor electrode, and a plurality of side electrodes arranged in said continuous space to face said rotating rotor electrode;

wherein said distributor cap includes an outer wall extending axially and an inner wall defining said caved portion inside of said outer wall;

wherein said inner wall extends axially to an extent substantially identical with said outer wall; and wherein said ignition coil is substantially completely received in said caved portion.

2. An ignition distributor according to claim 1, wherein said side electrodes are mounted at intervals in the circumferential direction on a portion of said distributor cap surrounding said caved portion, and at least tips of said side electrodes are projecting into said continuous space; and wherein each side electrode extends axially.

3. An ignition distributor for an internal combustion engine, comprising:

a hollow housing;

a distributor cap mounted on one end of said housing and having a caved portion, said caved portion extending toward said housing and defining a space continuous in a circumferential direction around said caved portion;

an ignition coil mounted in said caved portion of said distributor cap; and a distributor section including a shaft rotatably supported at an opposite end of said housing and adapted to be driven by the internal combustion engine, a rotor electrode disposed in said continuous space, holding means for holding said rotor electrode, joining said rotor electrode with the said shaft in a rotatable manner, and electrically connecting said ignition coil to said rotor electrode, and a plurality of side electrodes disposed in said continuous space to face said rotating rotor electrode, wherein said holding means includes an electrical insulating distribution rotor, a holding metal plate for fixing said distribution rotor to said shaft, and a conducting plate spring for pressing said rotor electrode onto said distribution rotor and electrically connecting said rotor electrode to said ignition coil.

4. An ignition distributor according to claim 3, wherein said housing is in a substantially cylindrical shape, and said distribution rotor is in a substantially bowl shape.

5. An ignition distributor according to claim 4, further comprising a rotation angle sensor provided in said housing, and a signal rotor for actuating said sensor, said rotation angle sensor being located at a position of substantially the same level as a tip of said shaft with respect to an axial direction of said shaft and arranged in a space between said bowl-like distribution rotor and said cylindrical housing, said signal rotor being fixed to the tip of said shaft to face said rotation angle sensor.

6. An ignition distributor for an internal combustion engine, comprising:

a shaft adapted to be driven for rotation by the internal combustion engine;

a hollow housing rotatable supporting at one end thereof, said shaft;

a distributor cap disposed at an opposite end of said housing and made of an electrical insulating material, said cap including cylindrical outer-circumferential wall attached to said housing, a radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft wherein said ignition distributor further comprises high-tension cords that are connected to the respective side electrodes, and holding members for side high-tension cords, wherein said radial wall of said distribution cap includes a plurality of towers that are formed on said radial wall and project in an axial direction of the ignition distributor, and ring shaped steps formed on outer peripheries of said towers, joints between said side electrodes and the associated high-tension cords being molded with a resin material except tips of said side electrodes, and said holding members each have claws that engage with said ring shaped steps of said towers and thus attach molded portions of said high-tension cords securely to said towers with tips of said side electrodes projecting into said ring like space.

7. An ignition distributor for an internal combustion engine, comprising:

a shaft adapted to be driven for rotation by the internal combustion engine;

a hollow housing rotatably supporting at one end thereof, said shaft;

a distributor cap disposed at an opposite end of said housing and made of an electrical insulating material, said cap including a cylindrical outer-circumferential wall attached to said housing, a radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft wherein said ignition distributor further comprises an igniter that is located on an opening end side of said coil receiving space to disconnect a primary current generated by said ignition coil, a terminal that electrically connects said igniter with said ignition coil in said coil receiving space, and a heat radiation plate that is attached to an opening end of said coil receiving portion to cover said coil receiving space and is brought into close contact with said igniter.

8. An ignition distributor according to claim 7, wherein said heat radiation plate has a name plate adhered to an outer surface of said heat radiation plate, and said name plate indicates cylinder numbers for said side electrodes and a rotating direction of said shaft.

9. An ignition distributor for an internal combustion engine, comprising:

a shaft adapted to be driven for rotation by the internal combustion engine;

a hollow housing rotatably supporting at one end thereof, said shaft;

a distributor cap disposed at an opposite end of said housing and made of an electrical insulating material, said cap including a cylindral outer-circumferential wall attached to said housing, a radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft wherein said ignition coil includes a core having two magnetic path portions that extend in parallel with said bottom wall of said coil receiving portion, a secondary coil wound around one of said two parallel magnetic path portions that is nearer to said bottom wall of said coil receiving portion, a primary coil wound around the other magnetic path portion, and an insulating resin material that is filled partly to a circumference of said secondary coil in said coil receiving space.

10. An ignition distributor for an internal combustion engine, comprising:

a shaft adapted to be driven for rotation by the internal combustion engine;

a hollow housing rotatably supporting at one end thereof, said shaft;

a distributor cap disposed at an opposite end of said housing and made of an electrical insulating material, said cap including a cylindral outer-circumferential wall attached to said housing, a radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft wherein said radial wall of said distributor cap has a hole for allowing said coil receiving space to communicate with said ring like space.

11. An ignition distributor for an internal combustion engine, comprising:

a shaft adapted to be driven for rotation by the internal combustion engine;

a hollow housing rotatably supporting at one end thereof, said shaft;

a distributor cap disposed at an opposite end of said housing and made of an electrical insulating material, said cap including a cylindral outer-circumferential wall attached to said housing, radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft wherein said ignition distributor further comprises a center electrode that is fixed to said bottom wall of said coil receiving portion and is adapted to be supplied with a high voltage generated by said ignition coil, a carbon brush connected to said center electrode, and a spring for holding said carbon brush, wherein said center electrode has a brush receiving portion that is defined by a cylindrical wall, said brush receiving portion having a pair of grooves that are formed on opposed sides of said cylindrical wall near an opening end of said cylindrical wall, the respective grooves penetrating parts of said cylindrical wall and extending in parallel with each other substantially perpendicularly to an axis of said cylindrical wall, said carbon brush being tapered toward its tip to form a tapered portion and received in said brush receiving portion, and said spring being in a clip like shape, inserting into said grooves of said brush receiving portion and clamping said tapered portion of said carbon brush to hold said brush.

12. An ignition distributor for an internal combustion engine, comprising:

a shaft adapted to be driven for rotation by the internal combustion engine;

a hollow housing rotatably supporting at one end thereof, said shaft;

a distributor cap disposed at an opposite end of said housing and made of an electrical insulating material, said cap including a cylindral outer-circumferential wall attached to said housing, a radial wall extending in a radially inward direction from an end of said outer-circumferential wall on an opposite side of said housing, and a coil receiving portion protruding from a radially-inward part of said radial wall towards said shaft, said coil receiving portion having a bottom wall and defining a coil receiving space on an opposite side of said shaft, said outer-circumferential wall and said coil receiving portion defining a ring like space therebetween; and ignition coil received in said coil receiving space;

a plurality of side electrodes disposed at intervals near said radial wall of said distributor cap and protruding into said ring like space;

a distribution rotor mounted on a tip of said shaft, extending from the shaft top around said coil receiving portion toward said ring like space, and made of an insulating material; and a rotor electrode supplied with a high voltage from said ignition coil and attached to said distribution rotor to face said side electrodes with rotation of said shaft wherein said ignition distributor further comprises a rotor holding plate, wherein said distribution rotor is formed in a bowl like shape, and said rotor holding plate is in a curved shape which extends from the tip of said shaft along an outer side surface of said bowl-like distributor rotor, being fixed to the tip of said shaft and fixedly holding said distribution rotor at a radially-outward part thereof.

13. An ignition distributor according to claim 12, further comprising a rotation angle sensor mounted in said housing, and a signal rotor associated with said sensor, said rotation angle sensor being separated from said ignition coil by said bowl-like distribution rotor and located at substantially the same level as the tip of said shaft with respect to an axial direction of said shaft, said signal rotor being fixed to the tip of said shaft to face said rotation angle sensor.

14. An ignition distributor according to claim 13, wherein said signal rotor includes a magnet holding plate that is fixed to the tip of said shaft, and a permanent magnet that is held on an outer periphery of said holding plate, and said rotation angle sensor comprises an electric pickup that generates an output voltage according to a variation in interlinkage flux generated by said permanent magnet.

15. An ignition distributor for an internal combustion engine, comprising:

a shaft adapted to be driven for rotation by the internal combustion engine;

a hollow housing rotatably supporting, at one end thereof, said shaft;

a distributor cap disposed at an opposite end of said housing and made of an electrical insulating material, said cap including a cylindrical outer-circumferential wall attached to said housing, a radial wall extending in a radially inward direction from an end of said outer-circumferential wall on an opposite side of said housing, and a coil receiving portion protruding from a radially-inward part of said radial wall toward said shaft, said coil receiving portion having a bottom wall and defining a coil receiving space on an opposite side of said shaft, said outer-circumferential wall and said coil receiving portion defining a ring like space therebetween;

an ignition coil received in said coil receiving space;

a plurality of side electrodes disposed at intervals near said radial wall of said distributor cap and projecting into said ring like space;

a distribution rotor mounted on a tip of said shaft, extending from the shaft tip around said coil receiving portion toward said ring like space, and made of an insulating material; and a rotor electrode supplied with a high voltage from said ignition coil and attached to said distribution rotor to face said side electrodes with rotation of said shaft;

wherein said hollow housing includes a bottom portion receiving an end of said shaft; and wherein said coil receiving portion of said distributor cap axially extends to a position near the end of said shaft to have a depth for substantially completely receiving therein said ignition coil.

16. An ignition distributor according to claim 15, wherein said rotor electrode extends from a radially-outward part of said distribution rotor in an axial direction of the ignition distributor, and a radially-outside surface of said rotor electrode that faces said side electrodes one by one is formed in an arc shape;

wherein said rotor electrode is made of a ceramic resistor material.

* * * * *